US010881947B2

(12) United States Patent
Ryan

(10) Patent No.: US 10,881,947 B2
(45) Date of Patent: Jan. 5, 2021

(54) GAME

(71) Applicant: Leggi Studios Pty Ltd., Sandringham (AU)

(72) Inventor: Leigh Michael Ryan, Sandringham (AU)

(73) Assignee: Leggi Studios Pty Ltd., Sandringham (AU)

( * ) Notice: Subject to any disclaimer, the term of this patent is extended or adjusted under 35 U.S.C. 154(b) by 40 days.

(21) Appl. No.: 16/422,249

(22) Filed: May 24, 2019

(65) Prior Publication Data

US 2019/0366196 A1 Dec. 5, 2019

(30) Foreign Application Priority Data

Jun. 1, 2018 (AU) ..... 2018901965

(51) Int. Cl.
*A63F 13/00* (2014.01)
*A63F 1/02* (2006.01)
*A63F 1/00* (2006.01)

(52) U.S. Cl.
CPC ..... *A63F 1/02* (2013.01); *A63F 2001/008* (2013.01)

(58) Field of Classification Search
CPC ..... G07F 17/3293; G07F 17/3276; G07F 17/3267; G07F 17/3262
See application file for complete search history.

(56) References Cited

U.S. PATENT DOCUMENTS

2006/0040720 A1* 2/2006 Harrison, Jr. ..... A63F 9/24 463/9
2008/0197573 A1* 8/2008 Palmer ..... A63F 1/04 273/298
2009/0121437 A1* 5/2009 Snow ..... G07F 17/322 273/303

* cited by examiner

*Primary Examiner* — Omkar A Deodhar
*Assistant Examiner* — Eric M Thomas
(74) *Attorney, Agent, or Firm* — Shackelford, Bowen, McKinley & Norton, LLP

(57) ABSTRACT

A method of playing a game between two or more players. The game comprises game-tokens, and playable-tokens comprising a plurality of action-tokens. The action tokens comprise a sequence of first action-tokens, and a sequence of second action-tokens wherein each second action-token corresponds to the identifier of a respective one of the first action tokens. The method comprises: providing one of the game-tokens to each player of the game; dealing a respective plurality of playable-tokens to each player; and playing in turn, by each player, a playable-token of the player's respective plurality of playable tokens if permitted by rules. According to the rules: a first action-token is playable against one of the game-tokens if the action-token is first in the sequence of first action-tokens, a subsequent action-token is playable against one of the game-tokens if the subsequent action-token follows or corresponds to a previous action-token most recently-played against the one of the game-tokens, at least one action-token played against one of the game-tokens is disregarded when the subsequent action-token played at least by the player of that one game token corresponds to the previous action-token. A player loses or is at risk of losing their game-token if the subsequent action-token is last in the sequence of first action-tokens, and a player is out of the game if the player loses their game-token.

19 Claims, 2 Drawing Sheets

GAME

FIELD

The present invention relates to game to be played by two or more players. The game may be played as a card game or as a computer game.

BACKGROUND

Existing card games, such as UNO, involve simple rules that allow it to be suitable for playing by all ages. The gameplay provided by these card games is random and the winning outcome is largely dependent on the cards in a player's hand. These games require no, or a very limited, element of strategy to win the game. Simply, the player with the better hand often wins without needing any strategy.

Other existing card games are available that require a degree of strategy to win besides only having a good hand. These existing games however involve sophisticated game rules and complex cards with different abilities, which limits the player engagement with, and enjoyability of, the game.

SUMMARY

The present invention seeks to provide a game that is simple to understand while allowing for tactical gameplay from a player. The present invention seeks to provide a tactical game that can be played by all ages. Additionally or alternatively, the present invention seeks to provide the public with a useful choice.

According to an aspect, the present invention provides a method of conducting a game between two or more players, the game comprising:

- game-tokens, and
- playable-tokens comprising a plurality of action-tokens, the action tokens comprising
  - a sequence of first action-tokens, and
  - a sequence of second action-tokens wherein each second action-token corresponds to the identifier of a respective one of the first action tokens,
- the method comprising:
  - providing at least one of the game-tokens to each player of the game;
  - dealing a respective plurality of playable-tokens to each player; and
  - playing in turn, by each player, a playable-token of the player's respective plurality of playable tokens if permitted by rules, the rules comprising:
    - an initial action-token being playable against one of the game-tokens if the action-token is first in the sequence of first action-tokens,
    - a subsequent action-token being playable against one of the game-tokens if the subsequent action-token follows or corresponds to a previous action-token most recently-played against the one of the game-tokens,
    - at least one action-token played against one of the game-tokens is disregarded when the subsequent action-token played at least by the player of that one game-token corresponds to the previous action-token,
    - the player loses or is at risk of losing their game-token if the subsequent action-token is last in the sequence of first action-tokens, and
    - a player is out of the game if the player has no game-tokens.

Optionally a player wins the game when all of the other players are out of the game. There may be one or more other ways in which a player can win the game. For example, a player may win the game if the player is a first one of the players to have no playable tokens, e.g. is the first to finish playing all of their playable-tokens (including any tokens that they have collected during the game). As another example, a player may win the game if all other players lose their game-tokens. Other example ways in which the player can win the game are described below.

A player may lose the game if each other player has played all of their respective playable-tokens.

The method may comprise providing two or more game-tokens to each player. The player will be out of the game if the player loses all of their game-tokens. Preferably, once the initial action token is played against one of the game-tokens of a player, another action-token cannot be played against another game-token of the same player until the player loses the one game-token or until all playable tokens played against the one game-token are disregarded. Alternatively, once the initial action token is played against one of the game-tokens of a player, another action token can be played against another game-token of the player while the one game-token is still in the game.

Each game-token may have a game-token identifier and each action-token may have an identifier corresponding to the game-token identifier, wherein the action-token is playable against the target game-token only if the game-token identifier of the action-token corresponds to the game-token identifier of the target game-token. The game-token identifier is preferably a color. The method preferably comprises providing two more game-tokens having an identical game-token identifier to each player. A player may win the game if each playable-token of the respective playable-tokens of the player is an action-token and the action-tokens have the same identifier (e.g. same number). The player may win the game if each playable-token of the respective playable-tokens of the player is an action-token and the identifier of each action token corresponds to the game-token identifier (e.g. color) of their game-token.

All action-tokens that have been played against one of the game-tokens may be disregarded when the subsequent action token corresponding to the previous action-token is played against the game-token. The subsequent action-token for disregarding the action-token(s) played against the one game-token can be played by the player of that one game-token. When another player plays the subsequent action-token corresponding to the previous action-token, the action-token(s) played against the game-token may not be disregarded. Alternatively, when another player plays the subsequent action token corresponding to the previous action-token, the previous action-token(s) is disregarded.

The sequence may be an alphanumeric sequence, and each action-token preferably has an alphanumeric value that lies in the alphanumeric sequence. The sequence may range from 1 to 50 inclusive for example. The sequence preferably is a sequence of 3. The sequence may alternatively range from 50 to 1 inclusive or from 'a' to 'z' inclusive. At least one of the action tokens may have more than one alphanumeric value that lies in the sequence. For example, the at least one action token may have two different values that lie in the alphanumeric sequence. Alternatively, the at least one action token may have more than two different values that lie in the alphanumeric sequence. The two or more values may be consecutive values in the sequence. Alternatively, the two or more values may be non-consecutive values in the sequence.

Each player can only play one playable-token in their turn. When a game-token of a player is at risk of being lost, the player preferably will have a turn to give the player an opportunity to save the game-token from being lost.

When the subsequent action-token that corresponds to the last action token in the sequence of first action-tokens is played against a player's game-token, their game-token may be at risk of being lost. Preferably, the player loses their game-token if the subsequent action-token is still against their game-token at the end of the player's turn. After the subsequent action-token that corresponds to the last action token in the sequence of first action-tokens is played against their game-token, the player or another player can play a playable-token from their respective playable-tokens to save the game-token.

The playable-tokens may comprise an instant-elimination token, the instant-elimination token is playable against one of the game-tokens to cause the player to be at risk of losing the game-token. When the instant-elimination token is played against a game-token of the player, the game-token may be at risk of being lost. Preferably, the player loses their game-token if the instant-elimination token is still against their game-token at the end of the player's turn.

Playable-tokens may comprise an instant-save token, the instant-save token being playable against one of the game-tokens to disregard at least one playable-token that has been played against the game-token. The instant-save token is preferably playable against the target game-token to disregard all playable-tokens played against the game-token. If a game-token is lost, the instant-save token is playable against the game-token to bring their game-token back into the game.

The playable-tokens may comprise an instant-action token, the instant-action token being playable against one of the game-tokens to either cause:

- a player to lose or to be at risk of losing the game-token; or
- at least one playable-token that has been played against the game-token to be disregarded from the game-token; or
- if the game-token is lost, to bring the target game-token back into the game.

The method may comprise providing a pool of playable-tokens. The step of dealing a respective plurality of playable-tokens to each player comprises dealing the respective plurality of playable-tokens from the pool.

The playable-tokens may comprise a draw-token, the draw-token being playable to cause one or more other players to draw one or more playable-tokens from the pool.

The method may comprise drawing, by a player, at least one playable-token from the pool if the player does not play any playable-token from their respective playable-tokens in their turn. The method preferably comprises providing two more game-tokens to each player, and

- if the player loses or is at risk of losing one of their game-tokens, and
- if the player does not have any playable-tokens that can be played to save their game-token, and
- if the player has one or more other game-tokens, their game-token is removed from the game and the player draws at least one playable-token from the pool.

A playable-token may be played against a game-token that is lost. The playable-token may be played against a game-token that is lost of a player that is out of the game.

Alternatively, the playable token can be played against a game-token that is lost of player that is still in the game. An action-token is playable against the game-token that is lost without following the sequence.

The playable-tokens may comprise a reverse-token, the reverse token being playable to reverse a playing order from player to player.

The playable-tokens may comprise a swap-token, the swap-token being playable to cause two players to swap their respective playable-tokens with each other.

The playable-tokens may comprise one or more additional sequence of action-tokens wherein each action-token in each additional sequence corresponds to a respective one of the first action-tokens.

According to another aspect, the present invention provides a method of conducting a game between two or more players on an electronic gaming system comprising a processor, a video display and player input controls, the method comprising:

- assigning, by the processor, one or more game-tokens to each player of the game;
- displaying, by the processor, the game-tokens of each player on the video display;
- maintaining, by the processor, a pool of playable-tokens comprising a plurality of action-tokens, the action tokens comprising
  - a sequence of first action-tokens, and
  - a sequence of second action-tokens wherein each second action-token corresponds to the identifier of a respective one of the first action tokens,
  - distributing, by the processor, a respective plurality of playable-tokens to each player from the pool of playable-tokens;
  - displaying, by the processor, the respective plurality of playable-tokens on the video display;
  - receiving, by the processor an input from each player via the player input controls, a selection of a playable-token of the player's respective plurality of playable tokens and actioning the selection if permitted by rules, the rules comprising:
    - an initial action-token being playable against one of the game-tokens if the action-token is first in the sequence of first action-tokens,
    - a subsequent action-token being playable against one of the game-tokens if the subsequent action-token follows or corresponds to a previous action-token most recently-played against the one of the game-tokens,
    - at least one action-token played against one of the game-tokens is disregarded when the subsequent action-token played at least by the player of that one game-token corresponds to the previous action-token,
    - the player loses or is at risk of losing their game-token if the subsequent action-token is last in the sequence of first action-tokens, and
    - removing, by the processor, a player from the game if the player has no game-tokens.

The method comprises the steps of the method of the previous aspect and its embodiments of the previous aspect described above.

As used herein, the term 'and/or' means 'and', 'or', or both. In a list that specifies two or more features with the term 'and/or', at least one of those features may be present.

As used herein, the term 'token' comprises a card, game piece, figurine, chip, tile, any other physical object, or electronic game data.

BRIEF DESCRIPTION OF DRAWINGS

An embodiment of the apparatus will now be described, by way of non-limiting example only, with reference to the accompanying drawings in which.

DESCRIPTION OF EMBODIMENTS

Figure 2:
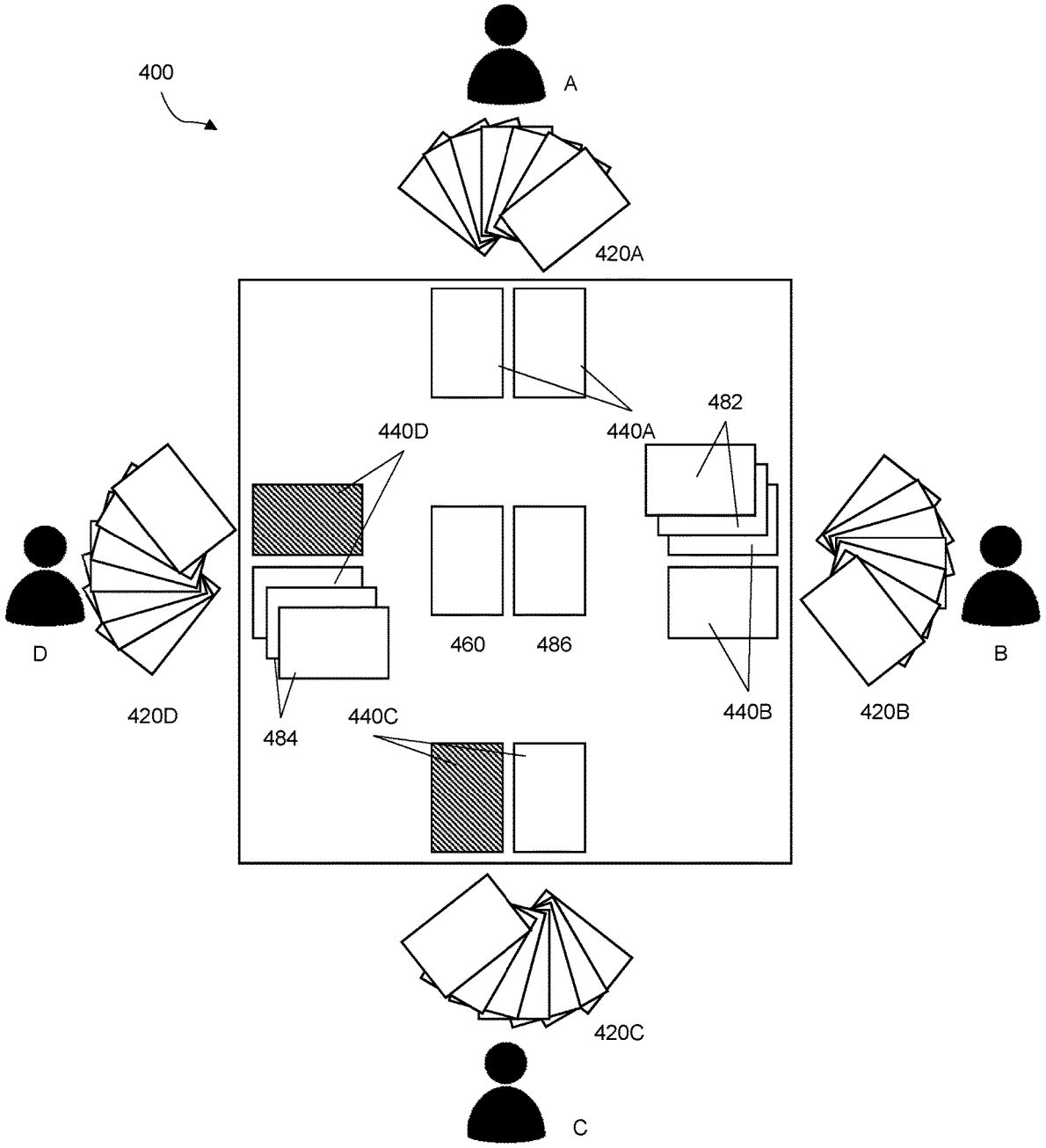
FIG. 2 shows a game layout according to one embodiment of the present invention.

Referring to FIG. 2, the game 400 comprises game cards 420 and playable cards 440. The game 400 can be played by two or more players, e.g. by four players as in FIG. 2. The players may comprise human players or, where the game is implemented on a computer, one or more human players and one or more machine players. Instead of cards, the game 100 may use other tokens such as figurines, chips, or tiles for example. In addition, where the game is implemented in a computer, the game uses virtual tokens. The game may be played in a free-for-all playing style, where every player can attack every other player. Alternatively, the game may be played in a team-based or cooperative style, where two or more players can team up against other players or other teams.

A game card represents the player's life in the game. The player is out of the game when the player loses their game card(s). A game card may be turned over to signify that it is out of the game. Each game card has a color (e.g. one of red, blue, green, yellow, etc). As will be described below, each player of the game is provided with two game cards having the same color, and the player is out of the game if they lose both of their game cards. In variations of the game, the player may be provided with one game card, more than two game cards, and/or different colored game cards. In variations of the game, the game card may have some other game card identifier besides a color such as an alphanumeric value, a symbol, or a picture for example.

A playable card is a card that can be played by a player against the game card of the player, against the game card of another player, against another player, or to change a game order. In general, the playable cards comprise cards that, when played, cause a game card to be lost, prevent a game card from being lost, cause players to swap hands, or reverse an order of play. Players can only play one playable card in their turn. Players are dealt playable cards, and can draw playable cards, from a deck of playable cards.

The playable cards comprise two or more sequences of action cards for each game card color. The action cards are playable against a game card to cause the game card to be lost or to prevent the game card from being lost. The sequence defines a sequence in which the action cards are playable against a game card. The sequence is an alphanumeric sequence ranging from 1 to 3 inclusive. Each action card has a respective value being one of 1, 2, or 3. It will be readily appreciated that the action card may have any other identifier and/or sequence range. Using the action cards, players can attack another player's game card by:

- playing a first action card in the sequence (having the value 1) against the game card, followed by
- playing a subsequent action card in the sequence (having the value 2) against the game card, followed by
- playing a last action card in the sequence (having the value 3) against the game card which puts the game card is at risk of being lost.

All of the action cards that have been played against a game card are kept on or next to the game card so that players can keep track of the sequence of action cards against the game card. Alternatively, a counter may be provided to keep track of the sequence. Action cards may be returned to a deck of playable cards once they have been played against a game card where the counter is provided.

All actions cards played against a game card is disregarded from the game card if an action card is played at least by the owner of that game card against the game card with a value corresponding to the value of the immediately-previous action card played against the game card. For example, if the immediately-previous action card against a game card has the value 2, playing an action card at least by the owner of that game card with the same value 2 causes the all of the previous action cards (of values 1 and 2) to be removed from the game card and returned to a deck of playable cards. Thereby, the sequence against the game card is reset. If another player plays an action card with a value corresponding to the value of the immediately-previous action card, the action card(s) played against that game card may not be disregarded. Rather, the action cards are maintained against the game card with the next playable action-card having a value corresponding to the previous action card or having a value being the next in the sequence. Alternatively, in a team-based or cooperative-style variation of the game, all actions cards played against a game card is disregarded from the game card if an action card is played against that game card by a player in the same team as the owner of that game card, the action card having a value corresponding to the value of the immediately-previous action card played against the game card.

Each action card also has an identifier corresponding to a respective one of the colors of the life cards (e.g. one of red, blue, green, yellow, etc). During the game, an action card is playable against a game card according to the sequence and if the color of the action card matches the color of the game card. The playable cards comprise at least two sequences of action cards for each game card color.

The playable cards comprise an instant-elimination card. The instant-elimination card can be played against a game card to cause the player to lose or be at risk of losing the game card. Unlike the action cards, the instant-elimination card is not restricted to game card color and can be played against any game card. The playable cards comprise only one instant-elimination card. Alternatively, more than one instant-elimination card may be provided.

In one variant of the game, once an instant-elimination card is played against a game card, it is returned to the deck. In another variant the instant-elimination card can be played only once and is thereafter out of the game. The instant-elimination card may eliminate a game card. It may also eliminate any action cards that are currently against that game card. The eliminated action cards might be removed from the game. Alternatively they may be returned to the pack.

In one variant of the game, when a player has two or more game cards and an elimination card is played against one of those game cards, the one game card is eliminated whilst any action cards against the other one or more game cards is/are taken away. The taken away action cards might be returned to the deck or removed from the game.

The playable cards comprise an instant-save card. The instant-save card can be played against one of the game card to disregard all of the playable cards (comprising action tokens) that have been played against the game card and returned to the deck of playable cards. In addition, if a game card is lost, the instant-save card can be played against the game card to bring that game card back into the game. Unlike the action cards, the instant-save card is not restricted to game card color and can be played against any game card. The playable cards comprise only one instant-save card. Alternatively, more than one instant-save card may be provided.

In one variant of the game, once an instant-save card is played against a game card, it is returned to the deck. In another variant the instant-save card can be played only once and is thereafter out of the game.

The playable cards comprise an instant-action card. The instant-action card can be played against a game card to cause:

- a player to lose or to be at risk of losing the game card; or
- all playable-tokens that have been played against the game card to be disregarded from the game card and returned to the deck of playable cards; or
- if the game card is lost, to bring the game back into the game.

Unlike the action cards, the instant-action card is not restricted to game card color and can be played against any game card. The playable cards comprise only one instant-action card. Alternatively, more than one instant-action card may be provided. Once an instant-action card is played against a game card, it is returned to the deck.

The playable cards comprise a draw card. The draw card can be played against a player to cause the player to draw two playable cards from the deck. Alternatively, the draw card can be played to cause the player to draw only one playable card or more than two playable cards from the deck.

The playable cards comprise a reverse card. The reverse card can be played to reverse a playing order from player to player. For example, if players of the game take turns in a clockwise order, playing the reverse card changes the order to a counter-clockwise order.

The playable cards comprise a swap card. The swap card can be played against a player to cause two players to swap their respective playable cards with each other. In particular, playing the swap card causes the player that played the swap card and a target player to swap hands.

If any one of the instant-elimination card, instant-save card, or instant-action card is returned to the deck during the game, the deck is reshuffled. In a variation, if any cards are returned to the deck during the game, the deck is reshuffled.

According to the rules of the game, a player can win the game if any one of the following conditions are met.

1. A player wins the game if the player is a first one of the players to finish playing all of their playable cards from their hand.
2. A player wins the game if the player has at least one game card left and all other players have lost their game cards.
3. A player wins the game all of the playable cards in their hand are action cards having the same color as their game card(s).

Figure 1:
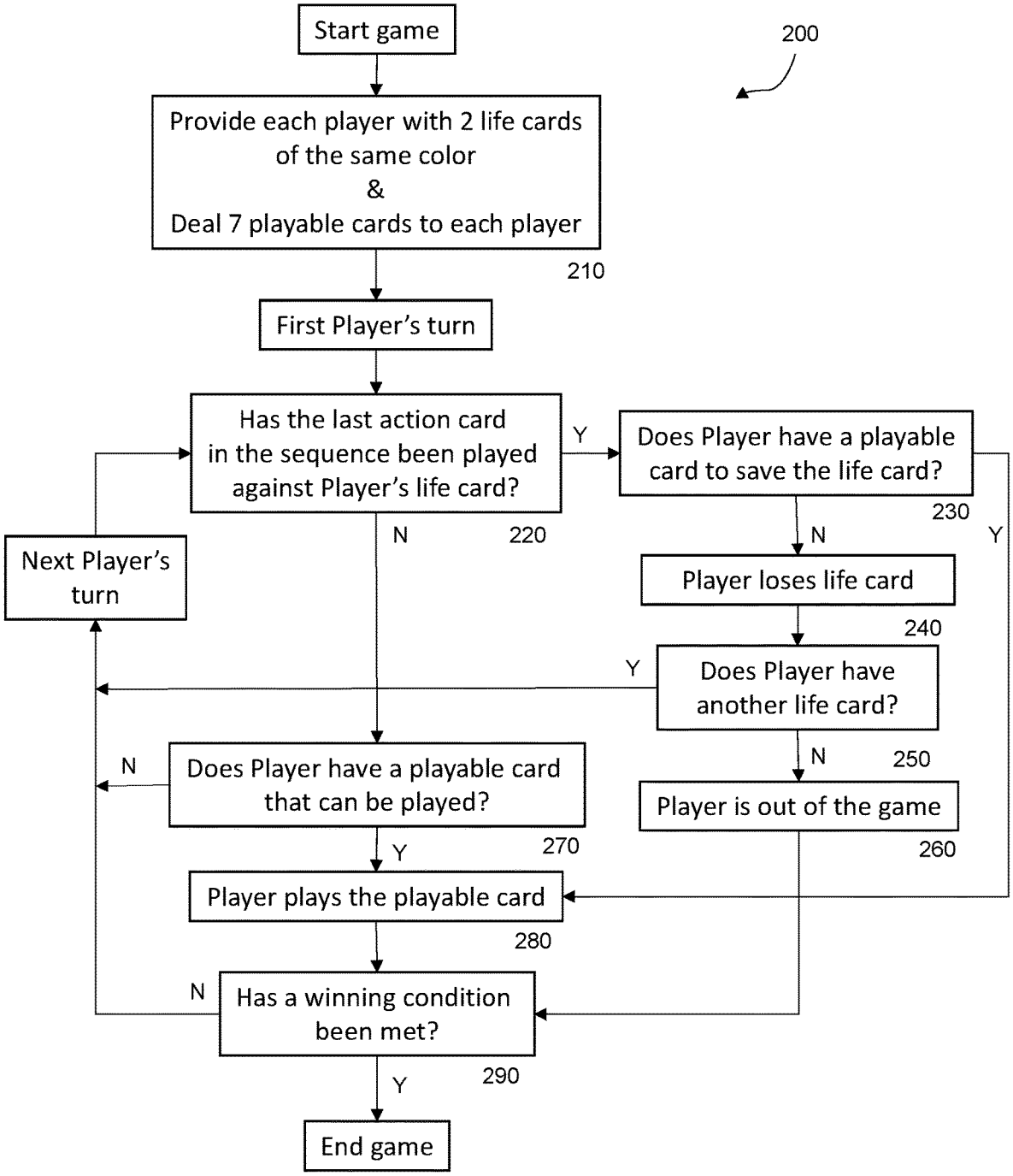
FIG. 1 shows the steps of playing the game according to one embodiment of the of the present invention.

Referring to FIG. 1, the setup phase of the game 200 involves providing each player with two game cards 210. Each player is allocated a respective color and the game cards provided to each player corresponds to the allocated color. As part of the setup phase, each player is also dealt with seven playable cards from a deck of playable cards. The deck comprises the playable cards previously described above.

The game is a turn-based game, with each player being given a turn. As an example, the game may be played by players in a clockwise order or in a counterclockwise order. As discussed above, if a reverse card is played during a player's turn, the order of play from player-to-player will reverse. In each turn, a player is only allowed to play one playable card. The first player to start the game may be selected at random. Alternatively, each player may take turns being a dealer for dealing the cards out to each player during the setup phase, and the first player to start the game may be either the dealer, the person to-the-left of the dealer, or the person to-the-right of the dealer.

In each player's turn, if a playable card has been played against any one of their game cards 420 that puts their game card at risk of being lost, the player is given an opportunity to save their game card from being lost in their turn. The playable card that puts a game card at risk of being lost may be any one of:

- an action card that is the last in the sequence of action cards (i.e. having the value 3); or
- an instant-elimination card; or
- an instant-action card.

If the player has a playable card that can save their game card from being lost 230, the player can play that playable card 280. The playable card that can be played to save their game card, depends on the playable card that placed the game card at risk of being lost. In particular:

- where an action card that is last in the sequence is played against the game card, the player can save their game card by playing an action card that is the last in the sequence of action cards having the same color, an instant-save card, or an instant-action card; or
- where an instant-elimination card or an instant-action card is played against the game card, the player can only save their game card by playing an instant-save card or an instant-action card.

If the player does not have a playable card in their hand that can save their game card from being lost 230, the player loses their game card 240. If the player has another game card that is still in the game 250, the player draws two cards from the deck of playable cards, and their turn is over. The game then continues to the next player. Otherwise, the player is out of the game 260 and the game proceeds to check if any one of the winning conditions have been met 290, which have been described in further detail above. If any one of the winning conditions are met, the game finishes. Otherwise, the game continues to the next player. In variations of the game, if the player loses a game card in their turn but has another game card that is still in the game, the player may play a playable card in their hand 270 in the same turn.

If at the start of the player's turn, none of the player's game cards are at risk of being lost 220, the player is allowed to play one of the playable cards in their hand 270. The allowable moves at this stage comprise:

1. a first action card can be played against a player's game card if the action card is first in the sequence and if a sequence of action cards is not currently being played against another game card of the same player;
2. a subsequent action card can be played against a game card if the subsequent action card follows or corresponds to a previous action card most recently-played against the game card, where
   a. if the subsequent action card is the last action token in the sequence, the game card is at risk of being removed at the end of the player of the game card's turn, or
   b. if the subsequent action card played by the player of the game card or played by another player on the same team as the player of the game card corresponds to the previous action card, all action cards previously played against the game card are disregarded and returned to the deck, c. if the subsequent action card played by another player corresponds to the previous action card, the action card previous played against the game card is not disregarded;

3. an instant-elimination card can be played against a game card to put the game card at risk of being lost;
4. an instant-save card can be played against the game card to disregard all of the playable cards played against the game card and to return those cards to the deck, or to bring a previously-lost life-card back into the game;
5. the instant-action card can be played against the game card to either cause:
   a. a player to be at risk of losing their game card,
   b. all playable cards played against the game card to be disregarded from the game card and to be returned to the deck, or
   c. a previously-lost game card to be brought back into the game;
6. a reverse-token can be played to reverse a playing order from player to player
7. a swap-token can be played to cause two players to swap their respective playable-tokens with each other.
8. an action card can be played against a game-token of the same color that has been removed from the game without following the sequence If the player has a playable card that meets any one of the allowable moves described above, the player can play that playable card 280. Otherwise, the player must draw one card from the deck and the game continues to the next player. If the player does not have a playable card that meets any one of the allowable moves above and if there are no cards left in the deck, the game simply continues to the next player.

Once the playable card has been played, the game proceeds to check if any one of the winning conditions have been met 290. If any one of the winning conditions are met, the game finishes. Otherwise, the game continues to the next player.

FIG. 2 shows a mid-game layout according to an embodiment of the present invention in a free-for-all playing style. The game is played by four players A, B, C, D and comprises the playable cards described above. The action cards define a sequence of values from 1 to 3 inclusive, with each action card having a respective value in the sequence. The game is played in a clockwise order from player to player. Each player A, B, C, D has a plurality of playable cards 420A, 420B, 420C, 420D with two game cards 440A, 440B, 440C, 440D dealt during the game setup phase. The deck of playable cards 460 is provided in the middle of the players. Playable cards that have been played 486 against a player (e.g. the swap card or draw card) or playable cards that change the game order (i.e. the reverse card) are left next to the playable deck 460

Player A has two game cards 440A that are still in the game. No action cards have been played against either of Player A's game cards 440A. Player B has two game cards 440B that are still in the game. Two action cards 482 have been played against a first one of Player B's game cards 440B. Where the initial action card 482 played against the first game card 440B has the value 1, and the second action card 482 played against the first game card 440B has the value 2, the next action card that can be played against that first game card 440B can either have the value 2 or value 3. If the next action card played against the first game card 440B is played by Player B and has the value 2, all of the action cards 482 are removed from the first game card 440B. On the other hand, if the next action card played against the first game card 440B is played by another player (besides Player B) and has the value 2, the previous action cards 482 are not removed from the first game card 440B. If the next action card played against the first game card 440B is played by another player (besides Player B) and has the value 3 (i.e. the last action card in the sequence), the first game card is at risk of being lost during or at the end of Player B's turn. During Player B's turn, Player B can save the first game card 440B using one or the more playable card described previously above. If Player B does not have any playable cards that can save the first game card, the first game card is lost and turned face down.

Player C has two game cards 440C with a first one of the game card being already lost from the game and a second one of the game card remaining in the game. Because the first game card 440C is lost, the first game card 440C is turned face down.

Player D has two game cards 440D with a first one of the game card being already lost from the game. Because the first game card 440D is lost, the first game card 440D is turned face down.

Two action cards 484 have been played against a second one of Player D's game cards 440D. Taking the example where the initial action card 484 played against the second game card 440D has the value 1, and the second action card 484 played against the second game card 440D has the value 2, the next action card that can be played against that second game card 440D can either have the value 2 or value 3. If the next action card played against the second game card 440D is played by Player D and has the value 2, all of the action cards 484 are removed from the second game card 440D. On the other hand, if the next action card played against the second game card 440D is played by another player (besides Player D) and has the value 2, the previous action cards 484 are not removed from the second game card 440D. If the next action card played against the second game card 440D is played by another player (besides Player D) and has the value 3 (i.e. the last action card in the sequence), the second game card 440D is at risk of being lost during or at the end of Player D's turn. During Player D's turn, Player D can save the second game card 440D using one or the more playable card described previously above. If Player D does not have any playable cards that can save the second game card, the second game card is lost and turned face down and, because Player D has already lost their first game card 440D, Player D is out of the game.

The game can be implemented on an electronic gaming system. The electronic gaming system may have computers or electronic gaming stations for the players of the game. Each computer has a computer processor, a video display and player input controls. The system comprises a game server that is in communication with the players' computers and has a database for containing player and game information. The server implements the rules of the game as described above, keeps track of the player's game tokens and respective playable tokens, and maintains a pool of playable tokens during a game instance.

While the above description refers to embodiments of a game, it will be appreciated that other embodiments can be adopted by way of different combinations of features. Such embodiments fall within the spirit and scope of this invention.

By way of example, one game card or more than two game cards may be provided to each player at the start of the game.

By way of further example, less than seven or more than seven playable cards may be provided to each player at the start of the game.

Other examples are described in the Summary section above.

The invention claimed is:

1. A method of conducting a game between two or more players, the game comprising:

game-tokens, and playable-tokens comprising a plurality of action-tokens, the action tokens comprising a sequence of first action-tokens, and a sequence of second action-tokens wherein each second action-token corresponds to the identifier of a respective one of the first action tokens, the method comprising:

providing at least one of the game-tokens to each player of the game;

dealing a respective plurality of playable-tokens to each player; and playing in turn, by each player, a playable-token of the player's respective plurality of playable tokens if permitted by rules, the rules comprising:

an initial action-token being playable against one of the game-tokens if the action-token is first in the sequence of first action-tokens, a subsequent action-token being playable against one of the game-tokens if the subsequent action-token follows or corresponds to a previous action-token most recently-played against the one of the game-tokens, at least one action-token played against one of the game-tokens is disregarded when the subsequent action-token played at least by the player of that one game-token corresponds to the previous action-token, the player loses or is at risk of losing their game-token if the subsequent action-token is last in the sequence of first action-tokens, and a player is out of the game if the player has no game-tokens.

2. The method of claim 1, wherein a player wins the game if the player is a first one of the players to have no playable-tokens.

3. The method of claim 1, comprising providing two or more game-tokens to each player.

4. The method of claim 3, wherein once the initial action token is played against one of the game-tokens of a player, another action-token cannot be played against another game-token of the same player until the player loses the one game-token or until all playable tokens played against the one game-token are disregarded.

5. The method of claim 1, wherein each game-token has a game-token identifier and each action-token has an identifier corresponding to the game-token identifier, wherein the action-token is playable against the target game-token only if the identifier of the action-token corresponds to the game-token identifier of the target game-token.

6. The method of claim 5, wherein the method comprises providing two more game-tokens having an identical game-token identifier to each player.

7. The method of claim 5, wherein a player wins the game if each playable-token of the respective playable-tokens of the player is an action-token and the identifier of the action-tokens are the same.

8. The method of claim 5, wherein a player wins the game if each playable-token of the respective playable-tokens of the player is an action-token and the identifier of the action token corresponds to the game-token identifier of their game-token.

9. The method of claim 1, wherein all action-tokens that have been played against one of the game-tokens are disregarded when the subsequent action token corresponds to the previous action-token.

10. The method of claim 1, wherein the sequence is a sequence of 3.

11. The method of claim 1, wherein when the subsequent action-token that corresponds to the last action token in the sequence of first action-tokens is played against their game-token, their game-token is at risk of being lost and the player loses their game-token if the subsequent action-token is still against their game-token at the end of the player's turn.

12. The method of claim 11, wherein after the subsequent action-token that corresponds to the last action token in the sequence of first action-tokens is played against their game-token, the player or another player can play a playable-token from their respective playable-tokens to save their game-token.

13. The method of claim 1, wherein the playable-tokens comprise an instant-elimination token;

the instant-elimination token is playable against one of the game-tokens to cause the player to be at risk of losing the game-token; and the player loses their game-token if the instant-elimination token is still against their game-token at the end of their turn.

14. The method of claim 1, wherein the playable-tokens comprise an instant-save token, the instant-save token being playable against one of the game-tokens to disregard at least one playable-token that has been played against the game-token.

15. The method of claim 14, wherein if a game-token is lost, the instant save token is playable against the game-token to bring their game-token back into the game.

16. The method of claim 1, wherein the playable-tokens comprise an instant-action token, the instant-action token being playable against one of the game-tokens to either cause:

a player to lose or to be at risk of losing the game-token; or at least one playable-token that has been played against the game-token to be disregarded from the game-token; or if the game-token is lost, to bring the game-token back into the game.

17. The method of claim 1, further comprising providing a pool of playable-tokens;

wherein the playable-tokens comprise a draw-token, the draw-token being playable to cause one or more other players to draw one or more playable-tokens from the pool.

18. The method of claim 1, further including providing a pool of playable-tokens;

wherein the method comprises drawing, by a player, at least one playable-token from the pool if the player does not play any playable-token from their respective playable-tokens in their turn.

19. A method of conducting a game between two or more players on an electronic gaming system comprising a processor, a video display and player input controls, the method comprising:

assigning, by the processor, one or more game-tokens to each player of the game;

displaying, by the processor, the game-tokens of each player on the video display;

maintaining, by the processor, a pool of playable-tokens comprising a plurality of action-tokens, the action tokens comprising a sequence of first action-tokens, and a sequence of second action-tokens wherein each second action-token corresponds to the identifier of a respective one of the first action tokens, distributing, by the processor, a respective plurality of playable-tokens to each player from the pool of playable-tokens;

displaying, by the processor, the respective plurality of playable-tokens on the video display;

receiving, by the processor an input from each player via the player input controls, a selection of a playable-token of the player's respective plurality of playable tokens and actioning the selection if permitted by rules, the rules comprising:

an initial action-token being playable against one of the game-tokens if the action-token is first in the sequence of first action-tokens, a subsequent action-token being playable against one of the game-tokens if the subsequent action-token follows or corresponds to a previous action-token most recently-played against the one of the game-tokens, at least one action-token played against one of the game-tokens is disregarded when the subsequent action-token played at least by the player of that one game-token corresponds to the previous action-token, the player loses or is at risk of losing their game-token if the subsequent action-token is last in the sequence of first action-tokens, and removing, by the processor, a player from the game if the player has no game-tokens.

* * * * *